US009195244B2

(12) United States Patent
Wang

(10) Patent No.: US 9,195,244 B2
(45) Date of Patent: Nov. 24, 2015

(54) VOLTAGE REGULATING APPARATUS WITH ENHANCEMENT FUNCTIONS FOR TRANSIENT RESPONSE

(71) Applicant: Shih-Wei Wang, Hualien County (TW)

(72) Inventor: Shih-Wei Wang, Hualien County (TW)

(73) Assignee: REALTEK SEMICONDUCTOR CORP., Hsinchu (TW)

( * ) Notice: Subject to any disclaimer, the term of this patent is extended or adjusted under 35 U.S.C. 154(b) by 241 days.

(21) Appl. No.: 13/866,235

(22) Filed: Apr. 19, 2013

(65) Prior Publication Data

US 2013/0285630 A1 Oct. 31, 2013

(30) Foreign Application Priority Data

Apr. 27, 2012 (TW) ..... 101115139 A

(51) Int. Cl.
*G05F 1/565* (2006.01)
*G05F 1/10* (2006.01)

(52) U.S. Cl.
CPC ..... *G05F 1/10* (2013.01)

(58) Field of Classification Search
None
See application file for complete search history.

(56) References Cited

U.S. PATENT DOCUMENTS 4,973,974 A * 11/1990 Suzuki ..... 341/118
6,559,623 B1 * 5/2003 Pardoen ..... 323/274
2004/0257053 A1 * 12/2004 Okubo et al. ..... 323/234
2005/0035746 A1 * 2/2005 Bernacchia et al. ..... 323/282
2008/0050139 A1 * 2/2008 Nakajima et al. ..... 399/69
2008/0089141 A1 * 4/2008 Nandi ..... 365/189.09
2011/0101934 A1 * 5/2011 Lopata et al. ..... 323/271

OTHER PUBLICATIONS

Hoi Lee et al., Design of Low-Power Analog Drivers Based on Slew-Rate Enhancement Circuits for CMOS Low-Dropout Regulators, IEEE Transactions on Circuits and Systems II: Express Briefs, 2005, p. 563-567, vol. 52, No. 9.
State Intellectual Property Office of the People's Republic of China, "Office Action", China, Jul. 28, 2014.

* cited by examiner

*Primary Examiner* — Timothy J Dole
*Assistant Examiner* — Lorena Bruner
(74) *Attorney, Agent, or Firm* — Morris, Manning & Martin, LLP

(57) ABSTRACT

A voltage regulating apparatus is disclosed. The voltage regulating apparatus includes: a power transistor having a control terminal, a first terminal for receiving a power supply, and a second terminal for providing an output voltage; a feedback circuit coupled to the second terminal, configured for providing a feedback voltage according to the output voltage; an amplifier having a source current unit and a sink current unit, configured for driving the power transistor through the control terminal by use of the source and sink current units according to a reference voltage and the feedback voltage; and a transient enhancement unit configured for monitoring the source and sink current units, and regulating a voltage at the control terminal according to the monitored result.

12 Claims, 3 Drawing Sheets

VOLTAGE REGULATING APPARATUS WITH ENHANCEMENT FUNCTIONS FOR TRANSIENT RESPONSE

CROSS-REFERENCE TO RELATED APPLICATIONS

This application claims the benefit of Taiwan application Serial No. 101115139, filed Apr. 27, 2012, the disclosure of which is incorporated by reference herein in its entirety.

TECHNICAL FIELD

The present disclosure relates to a voltage regulator, and more particularly, to a voltage regulating apparatus with enhancement functions for the transient response.

TECHNICAL BACKGROUND

A voltage regulator is a device designed to provide a specific constant voltage level over a range of load conditions. It is widely used in portable electronic devices, such as a cellular phone, a laptop computer, and a personal digital assistant (PDA). Due to the requirements of low power consumption and high reliability for portable electronic devices, remarkable endeavors have been involved in the design and fabrication of voltage regulators.

In the case that the load condition of the voltage regulator is switched from one to the other, the load current outputted by the voltage regulator may change suddenly. The fast change may produce transient electrical spikes or pulses at the output voltage, causing an unfavorable effect to most electronic devices of digital circuit. Therefore, it is in need to develop a new voltage regulating apparatus with enhancement functions for the transient load change. The enhancement functions can speed up the response for the load change and, concurrently, refrain the quiescent-state current from growing up, so that performance of the voltage regulators can be improved and battery duration of the portable devices can be extended, too.

TECHNICAL SUMMARY

Therefore, one of the objects of the present disclosure is to provide a voltage regulating apparatus with enhancement functions for the transient response, which can speed up the response for the load change and refrain the quiescent-state current from growing up.

According to one aspect of the present disclosure, one embodiment provides a voltage regulating apparatus, which includes: a power transistor having a control terminal, a first terminal for receiving a power supply, and a second terminal for providing an output voltage; a feedback circuit coupled to the second terminal, configured for providing a feedback voltage according to the output voltage; an amplifier having a source current unit and a sink current unit, configured for driving the power transistor through the control terminal by use of the source and sink current units according to a reference voltage and the feedback voltage; and a transient enhancement unit configured for monitoring the source and sink current units, and regulating a voltage at the control terminal according to the monitored result.

According to another aspect of the present disclosure, another embodiment provides a voltage regulating apparatus which includes: a power transistor having a control terminal, a first terminal for receiving a power supply, and a second terminal for providing an output voltage; a feedback circuit configured for providing a feedback voltage according to the output voltage; an amplifier having a source current unit and a sink current unit, configured for receiving a reference voltage and the feedback voltage, and driving the power transistor through the control terminal by use of the source and sink current units; and a transient enhancement unit configured for monitoring the source and sink current units, and charging or discharging the control terminal according to the monitored result.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings are given by way of illustration only, and thus are not limitative of the present disclosure and wherein.

DESCRIPTION OF THE EXEMPLARY EMBODIMENTS

For further understanding and recognizing the fulfilled functions and structural characteristics of the disclosure, several exemplary embodiments cooperating with detailed description are presented as the following. Reference will now be made in detail to the preferred embodiments, examples of which are illustrated in the accompanying drawings. In the following description of the embodiments, it is to be understood that the terms "first", "second" and "third" are used to describe various elements, these elements should not be limited by the term. Also, unless otherwise defined, all terms are intended to have the same meaning as commonly understood by one of ordinary skill in the art.

Figure 1:
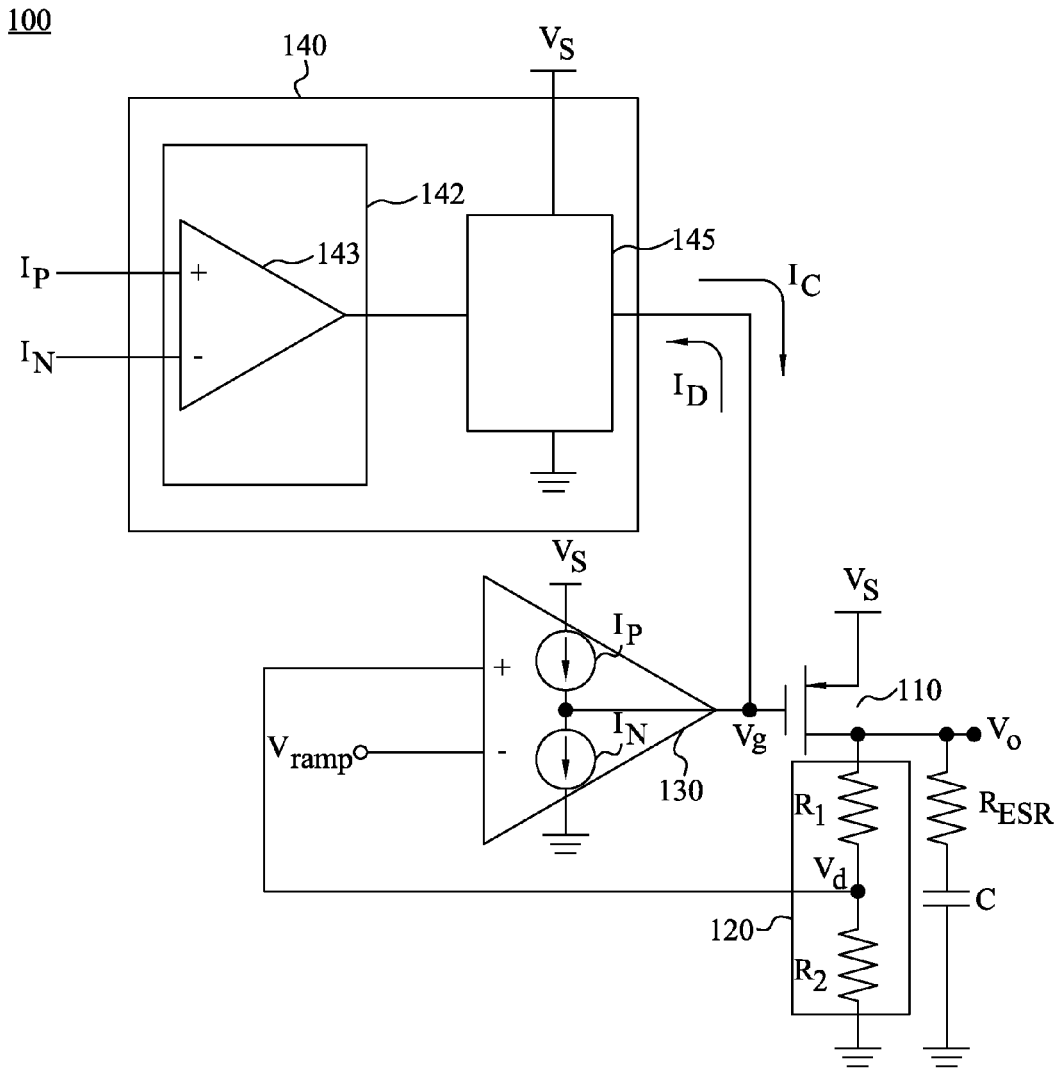
FIG. 1 schematically shows a circuit diagram of a voltage regulating apparatus according to an embodiment of the present disclosure.

FIG. 1 schematically shows a circuit diagram of a voltage regulating apparatus 100 according to an embodiment of the present disclosure, which can be used to describe the circuit operations of a voltage regulating apparatus with enhancement functions for the transient response. A voltage regulating apparatus can be referred to as "voltage regulator" or simply "regulator" in this disclosure. The embodiment can be applied to the circuit designs of various linear-type or switching-type regulators. A low-dropout (LDO) regulator is used in FIG. 1 as an example.

As shown in FIG. 1, the voltage regulating apparatus 100 may include a power transistor 110, a feedback circuit 120, an amplifier 130, and a transient enhancement unit 140. The power transistor 110 has three access terminals including a control terminal, a first terminal, and a second terminal, in which the first terminal is configured for receiving a power supply of voltage Vs for the voltage regulating apparatus 100, and the second terminal can be used to be an output terminal of the voltage regulating apparatus 100 to provide an output voltage Vo. In other words, the voltage regulating apparatus 100 may generate its output voltage Vo at the second terminal of the power transistor 110, so as to supply an electrical power of voltage Vo to an external circuit or device. Moreover, the power transistor 110 can be demonstrated by a metal-oxide-semiconductor field effect transistor (MOSFET). In the embodiment, the power transistor 110 is a p-channel MOSFET, with its gate acting as the control terminal as well as its source and drain acting as the first and second terminals.

To regulate the output voltage of the voltage regulating apparatus 100, the feedback circuit 120 is connected to the second terminal of the power transistor 110 to receive the output voltage Vo. A fraction of the output voltage Vo is fed back to be an input signal of the amplifier 130 at the non-inverting input terminal. The feedback circuit 120 can be formed of a voltage divider, which consists of two resistors $R_1$ and $R_2$ in series. The fraction voltage Vd can be found at the connection point between the resistors $R_1$ and $R_2$ by the voltage division. The fraction voltage Vd is used as a feedback signal in the embodiment and the feedback circuit 120 can be implemented with another means other than the above voltage divider. It should be noticed that the voltage regulating apparatus 100 may include an environmental capacitor C, an equivalent series resistor $R_{ESR}$, and an equivalent load impedance (not shown) due to the supplied external devices at the output voltage Vo terminal, as shown in FIG. 1.

The amplifier 130 amplifies the differential input signal between its non-inverting and inverting input terminals to drive the power transistor 110. The non-inverting input terminal receives the feedback signal of fraction voltage Vd, the inverting input terminal receives a stable reference voltage $V_{ramp}$, and the output terminal is connected to the control terminal of the power transistor 110. The amplifier 130 contains a source current unit with a source current $I_P$ and a sink current unit with a sink current $I_N$. The output terminal of the amplifier 130 is connected to the control terminal of the power transistor 110 to drive the power transistor 110, in which the output current is the current difference between the source current $I_P$ and the sink current $I_N$. The source current $I_P$ can be used to charge the power transistor 110, so as to raise its gate voltage $V_g$; while the sink current $I_N$ can be used to discharge the power transistor 110, so as to lower the gate voltage $V_g$. In the embodiment, the source current unit is implemented with a p-type MOS transistor and the sink current unit is implemented with an n-type MOS transistor.

The transient enhancement unit 140 can monitor the source current $I_P$ and the sink current $I_N$ in the amplifier 130, which are used to determine the operation state of the voltage regulating apparatus 100. For example, the voltage regulating apparatus 100 may operate in a steady state (referred to as "first state") or in a transient state (referred to as "second state"). The transient enhancement unit 140 can regulate the gate voltage $V_g$ of the power transistor 110 or either charge or discharge the gate of the power transistor 110 according to the monitored result.

In the embodiment, when the voltage regulating apparatus 100 is in a steady state, the output voltage Vo is stable or varies very slowly and the gate voltage $V_g$ of the power transistor 110 is also stable or varies slowly. Thus, the source current $I_P$ may be substantially equal to the sink current $I_N$, or the source current $I_P$ is not different from the sink current $I_N$ in a large extent. For example, the source current $I_P$ is less than twice as much as the sink current $I_N$, or the sink current $I_N$ is less than twice as much as the source current $I_P$. In such a circumstance, the amplifier 130 either does not charge or discharge the gate of the power transistor 110 or just charge or discharge the gate very slowly, to regulate the gate voltage $V_g$ by means of the source current $I_P$ and the sink current $I_N$.

On the other hand, when the output load of the voltage regulating apparatus 100 is switched from one load condition to another, the load current outputted by the voltage regulating apparatus 100 may change suddenly. The fast change may produce transient electrical spikes or pulses at the output voltage Vo. Due to the feedback configuration, the gate voltage $V_g$ of the power transistor 110 is also affected by the fast change. Generally, a power transistor has a large surface area. If the gate voltage $V_g$ varies too much, one of the source current $I_P$ and the sink current $I_N$ has to be much larger than the other one, so as to charge or discharge the gate of the power transistor 110. For example, the source current $I_P$ is more than twice as much as the sink current $I_N$, or the sink current $I_N$ is more than twice as much as the source current $I_P$. In a conventional regulator without the transient enhancement unit 140, it takes considerable time to charge or discharge the gate voltage $V_g$ to a desired voltage value. To speed up the regulation at the gate voltage $V_g$, the source current $I_P$ or the sink current $I_N$ has to be large enough, but this will render the regulator to dissipate a large current in the steady state. In this embodiment, however, the transient enhancement unit 140 is designed to have a circuit configuration for monitoring the source current $I_P$ and the sink current $I_N$ in the amplifier 130. For example, the transient enhancement unit 140 may operate in a switching hysteresis, which causes the gate voltage $V_g$ of the power transistor 110 to increase or decrease in a short time by use of a much large current, when the voltage regulating apparatus 100 is in the transient state. Here the transient state can be the case that the source current $I_P$ is larger than a value equal to a predetermined multiple (e.g., twice) of the sink current $I_N$, or the case that the sink current $I_N$ is larger than a value equal to a predetermined multiple (e.g., twice) of the source current $I_P$. As a consequence, the power transistor 110 can be quickly driven to provide a sufficient current and a much stable voltage for an external load device.

The transient enhancement unit 140 may include a control unit 142 and a current source 145. The control unit 142 is connected to the amplifier 130 and configured for comparing the source current $I_P$ and the sink current $I_N$. If the source current $I_P$ is larger than a value equal to a predetermined multiple of the sink current $I_N$, the control unit 142 may control the current source 145 to offer a current to the gate of the power transistor 110 to raise the gate voltage $V_g$. On the other aspect, if the sink current $I_N$ is larger than a value equal to a predetermined multiple of the source current $I_P$, the control unit 142 may control the current source 145 to sink in a current from the gate of the power transistor 110 to lower the gate voltage $V_g$. In one embodiment, the control unit 142 can connect the current source 145 to the gate of the power transistor 110 when the sink current $I_N$ is larger than twice as much as the source current $I_P$ or when the source current $I_P$ is larger than twice as much as the sink current $I_N$, so as to charge or discharge the gate of the power transistor 110 to respond to the load change. The current source 145 may have a current driving capacity larger than five times that of the source current $I_P$ and the sink current $I_N$. But it is not limited thereto, the current driving capacity can be determined according to the regulator's practical requirements for stability and response time.

In the following paragraphs, the circuit operation of the voltage regulating apparatus 100 in FIG. 1 will be described in detail. In a first situation when the load current at the output terminal of the voltage regulating apparatus 100 is increased gradually, the output voltage Vo may decrease gradually, causing the fraction voltage Vd fed back to the non-inverting input terminal of the amplifier 130 to decrease gradually, too. The sink current $I_N$ may be larger than the source current $I_P$, so that the gate voltage $V_g$ of the power transistor 110 can be pulled down gradually and thus the output current of the power transistor 110 can rise gradually, to respond to the gradually increasing load current. In a second situation when the load current at the output terminal is increased sharply or swiftly due to a transient load change, the transient enhancement unit 140 may compare the source current $I_P$ and the sink current $I_N$ in a switching-hysteresis manner. If the sink current $I_N$ is much larger than the source current $I_P$ (for example, if the sink current $I_N$ is larger than twice as much as the source current $I_P$ in the embodiment), the transient enhancement unit 140 can provide the output current $I_D$ of current source 145 to discharge the current energy at the gate of the power transistor 110, to respond to the sharply or swiftly increasing load current. The discharging current $I_D$ can pull down the gate voltage $V_g$ of the power transistor 110, so that the power transistor 110 can raise the output current at the output terminal of the voltage regulating apparatus 100, to respond to the sharply or swiftly increasing load current. The above description, the regulator is based on the operation of up-tracking load current.

On the other hand, the regulator can be driven according to the operation of down-tracking load current. In a first situation when the load current at the output terminal of the voltage regulating apparatus 100 is decreased gradually, the output voltage Vo may increase gradually, causing the fraction voltage Vd fed back to the non-inverting input terminal of the amplifier 130 to increase gradually, too. The source current $I_P$ may be larger than the sink current $I_N$, so that the gate voltage $V_g$ of the power transistor 110 can be pulled up gradually and thus the output current of the power transistor 110 can be lowered gradually, to respond to the gradually decreasing load current. In a second situation when the load current at the output terminal is reduced sharply or swiftly due to a transient load change, the transient enhancement unit 140 may compare the source current $I_P$ and the sink current $I_N$ in a switching-hysteresis manner. If the source current $I_P$ is much larger than the sink current $I_N$ (for example, if the source current $I_P$ is larger than twice as much as the sink current $I_N$ in the embodiment), the transient enhancement unit 140 can provide the output current $I_C$ of current source 145 to charge the gate of the power transistor 110, to respond to the sharply or swiftly decreasing load current. The charging current $I_C$ can pull up the gate voltage $V_g$ of the power transistor 110, so that the power transistor 110 can reduce the output current at the output terminal of the voltage regulating apparatus 100, to respond to the sharply or swiftly decreasing load current.

Figure 2:
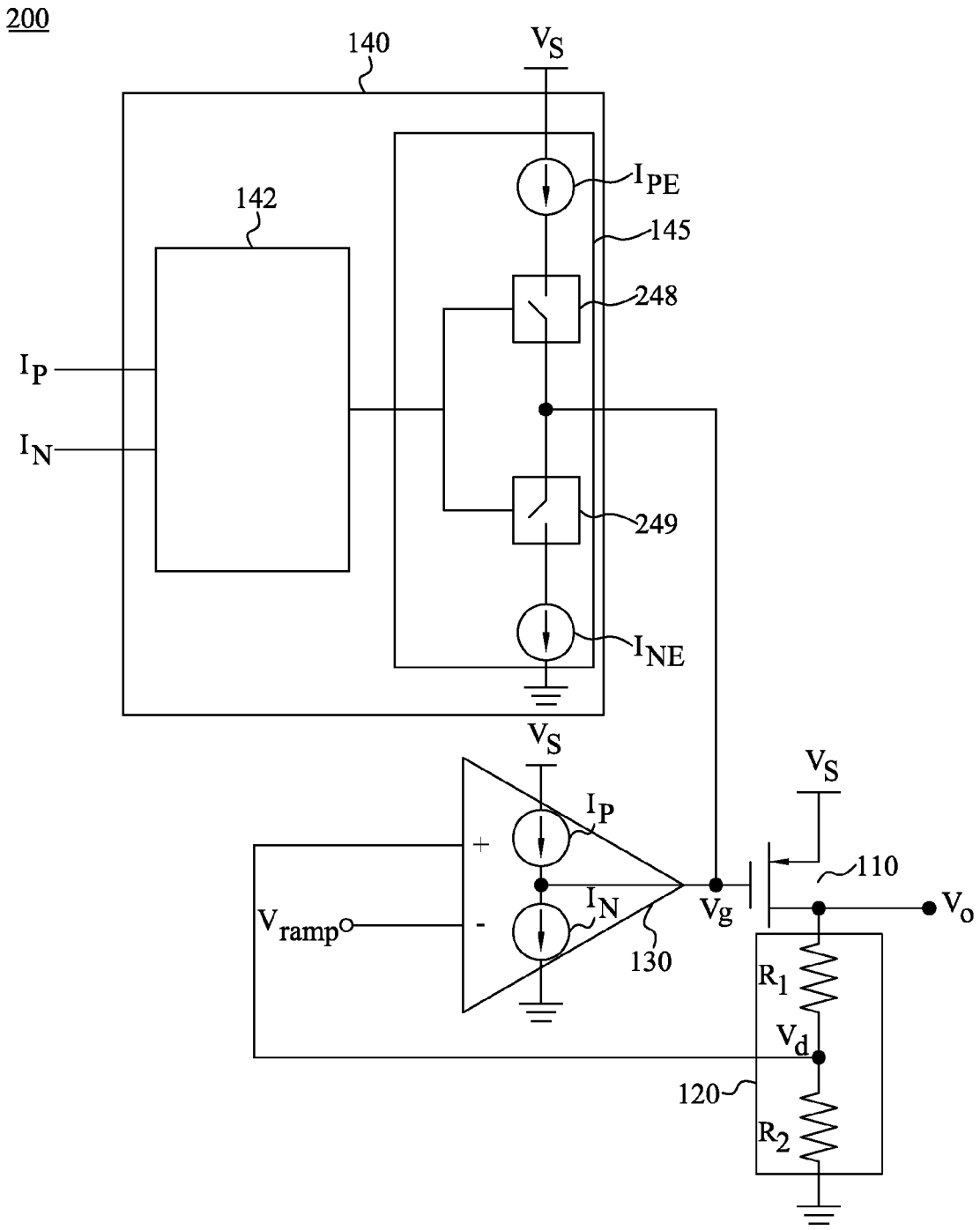
FIG. 2 schematically shows a circuit diagram of a voltage regulating apparatus according to another embodiment of the present disclosure.

FIG. 2 schematically shows a circuit diagram of a voltage regulating apparatus 200 according to another embodiment of the present disclosure, which is based on the circuit configuration in FIG. 1. The transient enhancement unit 140 includes a first current source $I_{PE}$ and a second current source $I_{NE}$ configured for regulating the voltage $V_g$ at the control terminal of the power transistor 110 according to the monitored result. The first current source $I_{PE}$ and the second current source $I_{NE}$ are arranged in a symmetrical circuit structure, similar to that of the source current $I_P$ and the sink current $I_N$ in the amplifier 130. The transient enhancement unit 140 may further include a first switch 248 and a second switch 249, connected to the first current source $I_{PE}$ and the second current source $I_{NE}$, respectively. If the source current $I_P$ is larger than a value equal to a predetermined multiple of the sink current $I_N$ in the amplifier 130, the control unit 142 may control the first current source $I_{PE}$ to raise the gate voltage $V_g$. In the embodiment, the control unit 142 is implemented by use of a comparator, which can reproduce the source current $I_P$ and the sink current $I_N$ proportionally by means of a current mirror or the like, and compare them to generate a control signal to the operational state (ON or OFF) of the first switch 248 and the second switch 249. The comparator may be of switching hysteresis to control the first switch 248 and the second switch 249. For example, if the sink current $I_N$ is larger than twice as much as the source current $I_P$, then the control unit 142 may control the second switch 249 to be turned on, so that the current of the second current source $I_{NE}$ can be used to drive the power transistor 110. If the source current $I_P$ is larger than twice as much as the sink current $I_N$, then the control unit 142 may control the first switch 248 to be turned on, so that the current of the first current source $I_{PE}$ can be used to drive the power transistor 110. The other elements or components in the embodiment are the same as those in FIG. 1 and are not described redundantly.

Figure 3:
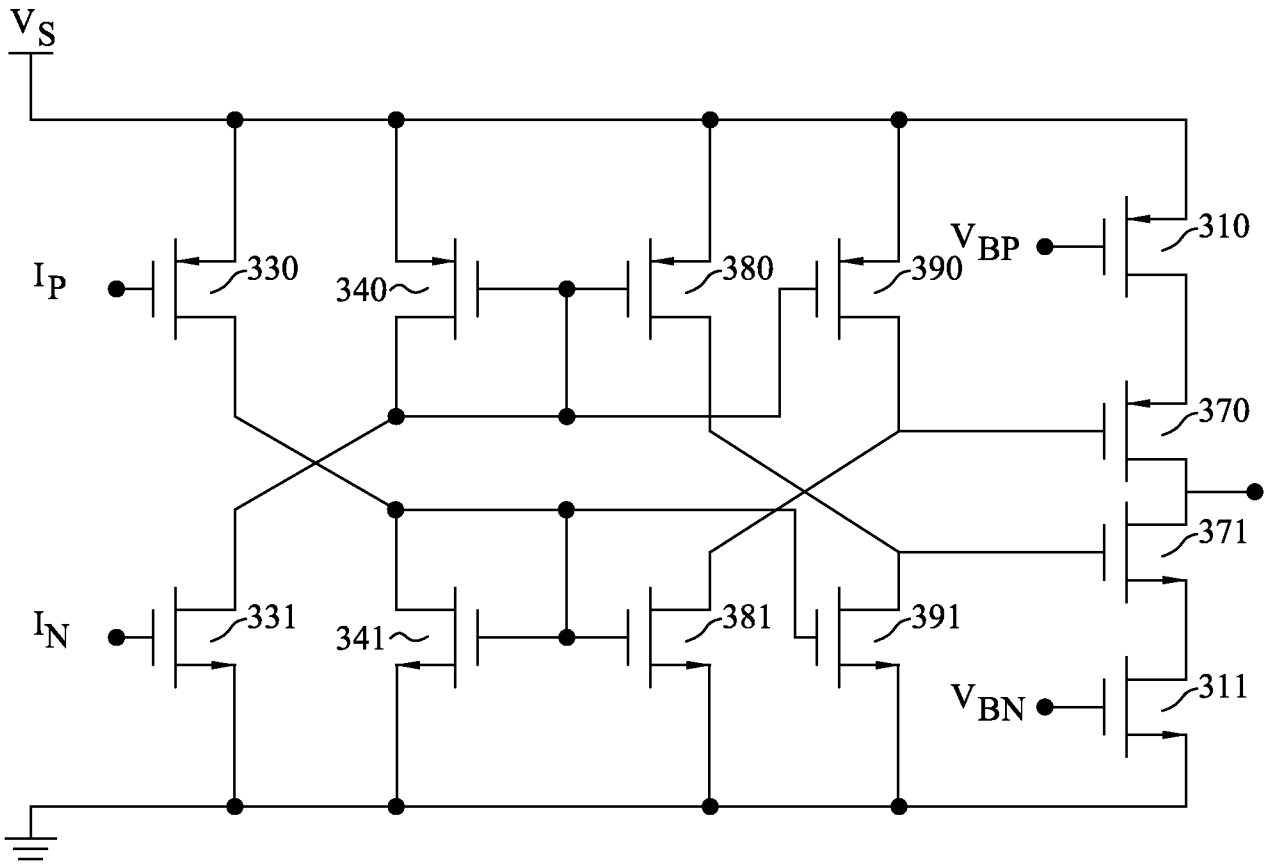
FIG. 3 schematically shows a circuit configuration of the transient enhancement unit as an example of the embodiment.

FIG. 3 schematically shows a circuit configuration of the transient enhancement unit 140 as an example of the second embodiment, in which Vs is the power supply for the voltage regulating apparatus. The transient enhancement unit includes six p-channel MOSFETs and six n-channel MOSFETs. The gate of the p-channel MOSFET 330 receives a biased-voltage signal representing the source current $I_P$ from the amplifier 130, while the gate of the n-channel MOSFET 331 receives a biased-voltage signal representing the sink current $I_N$ from the amplifier 130. The p-channel MOSFET 330 and a n-channel MOSFET 341 are combined to be a current mirror delivering a current equal to the source current $I_P$, and the n-channel MOSFET 340 and a p-channel MOSFET 340 are combined to be another current mirror delivering a current equal to the sink current $I_N$. The control unit 142 or the comparator in the second embodiment can be implemented with the p-channel MOSFETs 330/340/380/390 and the n-channel MOSFETs 331/341/381/391, which compare the source current $I_P$ and the sink current $I_N$ to produce a control signal to control the operational state (ON or OFF) of a p-channel MOSFET 370 and an n-channel MOSFET 371.

As to the p-channel MOSFET 310, the source is connected to the power supply of voltage Vs, the drain is connect the first switch 248, and the gate is provided with a first predetermined voltage $V_{BP}$, so that the p-channel MOSFET 310 can deliver a constant drain current which acts as the first current source $I_{PE}$ in the second embodiment. As to the n-channel MOSFET 311, the source is grounded, the drain is connect the second switch 249, and the gate is provided with a first predetermined voltage $V_{BN}$, so that the n-channel MOSFET 311 can deliver another constant drain current which acts as the second current source $I_{NE}$ in the second embodiment. The p-channel MOSFET 370 may act as the first switch 248 in the second embodiment, wherein its gate is connected to the drain of the p-channel MOSFET 390. The n-channel MOSFET 371 may act as the first switch 248 in the second embodiment, wherein its gate is connected to the drain of the n-channel MOSFET 391. As a consequence, the control signal generated by the control unit 142 or the comparator can be received by the MOSFETs 370 and 371.

In the embodiments, when the voltage regulating apparatus 200 operates in a steady state, the source current $I_P$ may approximate to the sink current $I_N$; for example, in the extent that the source current $I_P$ is less than twice as much as the sink current $I_N$ or the sink current $I_N$ is less than twice as much as the source current $I_P$. In such a circumstance, the p-channel MOSFET 370 (acting as the first switch) and the n-channel MOSFET 371 (acting as the second switch) are turned off, so that the transient enhancement unit 140 will not provide the power transistor 110 with the current for transient enhancement. On the other aspect, when the voltage regulating apparatus 200 operates in a transient state, the p-channel MOSFET 370 or the n-channel MOSFET 371 will be turned on. For example, if the source current $I_P$ is less than twice as much as the sink current $I_N$ in the amplifier 130, the p-channel MOSFET 370 may be turned on and the n-channel MOSFET 371 may be turned off, so that the drain current of the p-channel MOSFET 310 (acting as the first current source $I_{PE}$) will charge the control terminal of the power transistor 110 to raise the gate voltage $V_g$, so as to enhance the transient response for a sudden load change. For another example, if the sink current $I_N$ is less than twice as much as the source current $I_P$ in the amplifier 130, the n-channel MOSFET 371 may be turned on and the p-channel MOSFET 370 may be turned off, so that the drain current of the n-channel MOSFET 311 (acting as the second current source $I_{NE}$) will discharge the control terminal of the power transistor 110 to lower the gate voltage $V_g$, so as to enhance the transient response for a sudden load change. Here, the MOSFET 370 or 371 can have a current driving capacity larger than five times the source current $I_P$ or the sink current $I_N$; but is not limit thereto.

As set forth in the embodiments, a transient enhancement unit is used in the present disclosure to speed up the response of a voltage regulating apparatus for transient load change, with a small quiescent-state current in a stable loading. Thus, no extra current will be dissipated in the steady state. With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A voltage regulating apparatus, comprising:

a power transistor, having a control terminal, a first terminal for receiving a power supply, and a second terminal for providing an output voltage;

a feedback circuit, coupled to the second terminal, configured for providing a feedback voltage according to the output voltage;

an amplifier having a source current unit and a sink current unit, configured for driving the power transistor through the control terminal by use of the source and sink current units according to a reference voltage and the feedback voltage; and a transient enhancement unit, configured for monitoring the source and sink current units, and regulating a voltage at the control terminal according to the monitored result.

2. The voltage regulating apparatus according to claim 1, wherein the transient enhancement unit comprises:

a control unit, comprising a comparator, configured for comparing a source current of the source current unit and a sink current of the sink current unit to produce the monitored result; and a current source, comprising a first current unit and a second current unit, configured for regulating the voltage at the control terminal according to the monitored result.

3. The voltage regulating apparatus according to claim 2, wherein the control unit increases the voltage at the control terminal by use of the first current unit when the source current is larger than a value equal to a predetermined multiple of the sink current.

4. The voltage regulating apparatus according to claim 2, wherein the control unit decreases the voltage at the control terminal by use of the second current unit when the sink current is larger than a value equal to a predetermined multiple of the source current.

5. The voltage regulating apparatus according to claim 2, wherein the comparator has a switching hysteresis, which causes the control unit to control the first current unit to offer a current to the control terminal when the source current is larger than twice as much as the sink current, so as to raise the voltage at the control terminal.

6. The voltage regulating apparatus according to claim 2, wherein the comparator has a switching hysteresis, which causes the control unit to control the second current unit to let a current sink in from the control terminal when the sink current is larger than twice as much as the source current, so as to lower the voltage at the control terminal.

7. The voltage regulating apparatus according to claim 2, wherein the first current unit has a current driving capacity larger than five times that of the second current unit.

8. The voltage regulating apparatus according to claim 2, wherein the second current unit has a current driving capacity larger than five times that of the first current unit.

9. A voltage regulating apparatus, comprising:

a power transistor, having a control terminal, a first terminal for receiving a power supply, and a second terminal for providing an output voltage;

a feedback circuit, configured for providing a feedback voltage according to the output voltage;

an amplifier having a source current unit and a sink current unit, configured for receiving a reference voltage and the feedback voltage, and driving the power transistor through the control terminal by use of the source and sink current units; and a transient enhancement unit, configured for monitoring the source and sink current units, and charging or discharging the control terminal according to the monitored result.

10. The voltage regulating apparatus according to claim 9, wherein the transient enhancement unit comprises:

a control unit, configured for comparing a source current of the source current unit and a sink current of the sink current unit to produce the monitored result.

11. The voltage regulating apparatus according to claim 10, wherein the transient enhancement unit further comprises:

a current source, configured for offering a current to the control terminal when the source current is larger than a value equal to a predetermined multiple of the sink current.

12. The voltage regulating apparatus according to claim 10, wherein the transient enhancement unit further comprises:

a current source, configured for receiving a current from the control terminal when the sink current is larger than a value equal to a predetermined multiple of the source current.

* * * * *